US006505365B1

(12) United States Patent
Hanson et al.

(10) Patent No.: US 6,505,365 B1
(45) Date of Patent: Jan. 14, 2003

(54) HOSPITAL BED MECHANISMS

(75) Inventors: Thomas W. Hanson, Loveland, OH (US); John P. Biondo, Aurora, IN (US); Darrell L. Metz, Batesville, IN (US); Dennis E. Geiling, Brookville, IN (US); James J. Saar, Guilford, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/458,780

(22) Filed: Dec. 10, 1999

Related U.S. Application Data

(60) Provisional application No. 60/111,850, filed on Dec. 11, 1998, and provisional application No. 60/112,149, filed on Dec. 14, 1998.

(51) Int. Cl.[7] ..... A47B 7/00

(52) U.S. Cl. ..... 5/613; 5/611; 5/618; 5/662; 5/510

(58) Field of Search ..... 5/11, 611, 613, 5/616, 617, 618, 610, 662, 510

(56) References Cited

U.S. PATENT DOCUMENTS

| | | | | |
|---|---|---|---|---|
| 392,009 | A | | 10/1888 | Cleaveland |
| 541,339 | A | * | 6/1895 | Thompson ..... 5/504.1 |
| 1,206,536 | A | | 11/1916 | Hill |
| 1,218,519 | A | | 3/1917 | Bradley |
| 1,347,271 | A | * | 7/1920 | Hartman ..... 5/507.1 |
| 1,902,249 | A | | 3/1933 | Lanzy |
| 2,026,153 | A | | 12/1935 | Wright et al. |
| 2,681,454 | A | * | 6/1954 | Tallman ..... 5/611 |
| 2,913,300 | A | | 11/1959 | Darnell et al. |
| 2,968,050 | A | | 1/1961 | Shankman |
| 3,012,253 | A | * | 12/1961 | Reichert ..... 5/616 |
| 3,061,843 | A | | 11/1962 | Singer et al. |
| 3,237,212 | A | | 3/1966 | Hillenbrand et al. |
| 3,271,795 | A | | 9/1966 | Hillenbrand et al. |
| 3,281,872 | A | | 11/1966 | Dewey |
| 3,309,717 | A | * | 3/1967 | Black ..... 5/618 |
| 3,436,769 | A | | 4/1969 | Burst |
| 3,564,627 | A | | 2/1971 | Allard et al. |
| 3,633,225 | A | | 1/1972 | Burst et al. |
| 3,636,573 | A | | 1/1972 | Bartz |
| RE27,966 | E | | 4/1974 | Burst |
| 3,821,821 | A | | 7/1974 | Burst et al. |
| 3,974,530 | A | | 8/1976 | Lusch et al. |
| 4,005,497 | A | | 2/1977 | Sutter |

(List continued on next page.)

FOREIGN PATENT DOCUMENTS

| | | |
|---|---|---|
| DE | 2 023 104 | 11/1971 |
| DE | 35 16081 | 11/1986 |
| EP | 0 403 073 | 12/1990 |
| EP | 0 558 838 A1 | 9/1993 |
| FR | 2 725 600 | 4/1996 |
| WO | WO 98/20829 | 5/1998 |

*Primary Examiner*—Lynne H. Browne
*Assistant Examiner*—James M. Hewitt
(74) *Attorney, Agent, or Firm*—Bose McKinney & Evans LLP

(57) ABSTRACT

A mechanism for raising and lowering the height of a patient support surface of a bed which includes a threaded shaft upon which a pulley support is raised and lowered and a chain and pulley system which transfers vertical displacement of the pulley support to the patient support surface. An articulating perimeter frame for supporting a patient on a bed frame which includes a plurality of extruded elongate members which are coupled together by hinges and corner members. The perimeter frame receives and supports inserts which receive head, seat and foot mattress sections. A pivotal push handle/tray combination that is pivotally coupled to the end posts of a bed and includes a mechanism for locking the handle/tray combination into one of a plurality of positions.

23 Claims, 14 Drawing Sheets

U.S. PATENT DOCUMENTS

| | | | | | |
|---|---|---|---|---|---|
| 4,043,219 | A | | 8/1977 | Schätti | |
| 4,346,487 | A | | 8/1982 | Holdt et al. | |
| 4,435,861 | A | * | 3/1984 | Lindley | 5/618 |
| 4,494,259 | A | | 1/1985 | Miller et al. | |
| 4,724,555 | A | | 2/1988 | Poehner et al. | |
| 5,020,169 | A | * | 6/1991 | Hamada et al. | 5/11 X |
| 5,279,010 | A | | 1/1994 | Ferrand et al. | |
| 5,544,375 | A | | 8/1996 | Urness et al. | |
| 5,685,035 | A | | 11/1997 | Urness et al. | |
| 5,706,536 | A | | 1/1998 | Krauska | |
| 5,724,685 | A | | 3/1998 | Weismiller et al. | |
| 5,802,639 | A | | 9/1998 | Raasch et al. | |
| 5,940,911 | A | * | 8/1999 | Wang | 5/610 |
| 6,058,798 | A | * | 5/2000 | Lantzsch | 5/618 X |
| 6,101,647 | A | * | 8/2000 | Stroud et al. | 5/618 |

* cited by examiner

HOSPITAL BED MECHANISMS

RELATED APPLICATIONS

The present application is based upon U.S. Provisional Patent Application Ser. No. 60/111,850, filed Dec. 11, 1998 and U.S. Provisional Patent Application Ser. No. 60/112,149, filed Dec. 14, 1998, the complete disclosures of which are both hereby expressly incorporated herein by reference.

BACKGROUND AND SUMMARY OF THE INVENTION

The present invention relates to various mechanisms for hospital beds. More particularly, the present invention relates to hospital bed mechanisms that move a patient support deck of the bed between a high position and a low position. The present invention further relates to an articulating patient support mechanism that includes a perimeter frame. In addition, the present invention relates to a pivotal handle/tray mechanism that can be provided at either or both ends of a hospital bed.

According to other features, characteristics, embodiments and alternatives of the present invention which will become apparent as the description thereof proceeds below, the present invention provides a bed assembly having a height-adjustable patient support surface which bed includes:

a head end and a foot end;

a pair of hollow support tubes at each of the head end and the foot end;

a first carriage movably coupled to the pair of hollow support tubes at the head end and a second carriage movably coupled to the pair of hollow support tubes at the foot end;

a frame for supporting a patient support surface, said frame having opposite ends that are coupled to the first and second carriage; and mechanism for raising and lowering the first and second carriages and the frame with respect to the pairs of hollow support tubes, the mechanism including a rotatable threaded shaft having a pulley support coupled thereto for movement along the shaft.

The present invention further provides a patient support assembly for an articulating bed which includes:

a bed frame that is supported at opposite ends;

a perimeter frame that includes a head section, a seat section, and a foot section, the seat section being coupled to the head section by a pair of first hinges and coupled to the foot section by a pair of second hinges;

a support bar that is coupled to the bed frame and to each of the pair of first hinges; and head, seat and foot inserts which are received within the respective head, seat and foot sections of the perimeter frame.

The present invention also provides a pivotal push handle assembly for hospital beds which includes:

spaced apart posts at an end of a bed;

corner connectors provided on tops of the spaced apart post; and a push handle pivotally coupled between the comer connectors.

The present invention also further provides a hospital bed which includes:

a head end and a foot end;

a pair of hollow support tubes at each of the head end and the foot end;

a first carriage having a pair of spaced apart outer tubes and being movable coupled to the pair of hollow support tubes at the head end and a second carriage having a pair of spaced apart outer tubes and being movable coupled to the pair of hollow support tubes at the foot end;

a frame for supporting a patient support surface, said frame having opposite ends that are coupled to the first and second carriage;

hi/lo mechanism for raising and lowering the first and second carriages and the frame with respect to the pairs of hollow support tubes.

a perimeter frame that includes a head section, a seat section, and a foot section, the seat section being coupled to the head section by a pair of first hinges and coupled to the foot section by a pair of second hinges;

a support bar that is coupled to the frame and to each of the pair of first hinges;

head, seat and foot inserts which are received within the respective head, seat and foot sections of the perimeter frame;

corner connectors provided on tops of at least one of the pair of spaced apart outer tubes; and a push handle pivotally coupled between the corner connectors.

BRIEF DESCRIPTION OF DRAWINGS

The present invention will be described hereafter with reference to the attached drawings that are given as non-limiting examples only, in which.

DETAILED DESCRIPTION OF THE DRAWINGS

Figure 1:
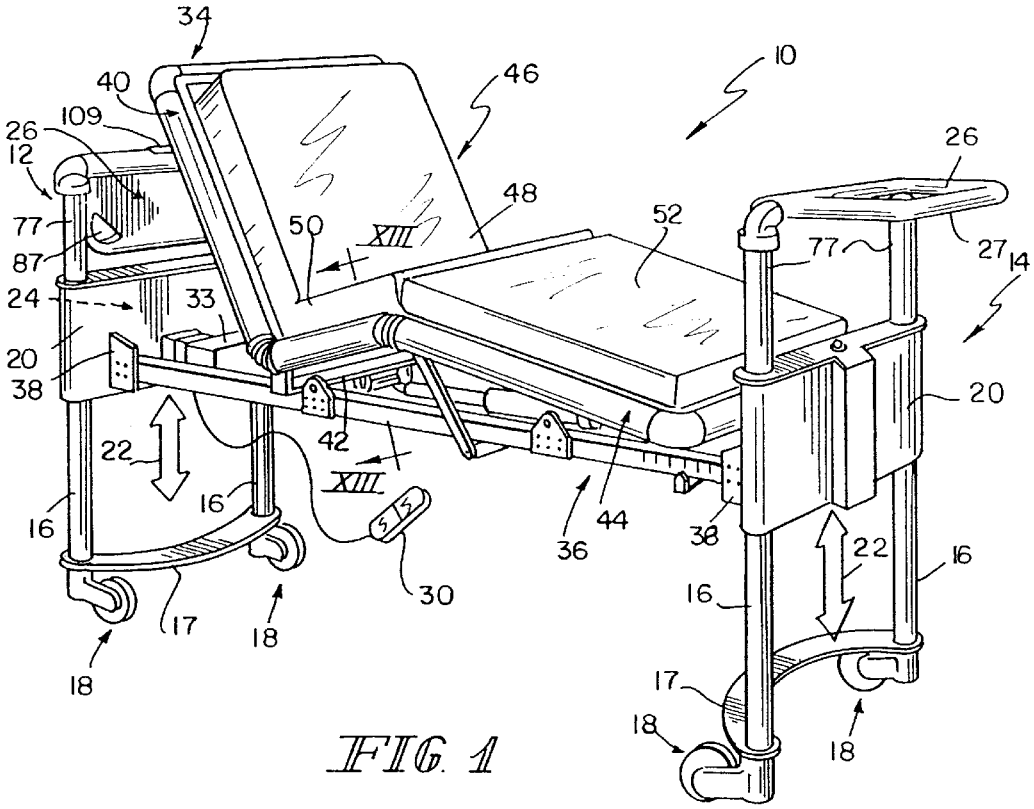
FIG. 1 is a perspective view of a hospital bed according to one embodiment of the present invention.

FIG. 1 is a perspective view of a hospital bed according to one embodiment of the present invention. FIG. 1 illustrates a hospital bed 10 that includes a head end 12 and a foot end 14. The head end 12 and the foot end 14 each include spaced-apart, hollow support tubes 16. A curved support member 17 is coupled between tubes 16 at both the head end 12 and foot end 14. Support members 17 provide stability for the tubes 16. Support members 17 are curved inwardly as shown in FIG. 1 to reduce the likelihood that the support members 17 will be in the way of a caregiver pushing the bed or in the way of equipment located near either end of the bed. Each support tube 16 has a caster assembly 18 coupled to its lower end. Movable covers 20 slide up and down in the direction of double headed arrows 22 on tubes 16 in response to movement of a hi/lo mechanism 24 discussed below with reference to FIG. 3. Covers 20 are coupled to tubes 77 so as to move up and down together with tubes 77 that are positioned over tubes 16 as discussed below.

A push handle 26 is pivotably coupled to top end of tubes 77 at both the head end 12 and foot end 14. In FIG. 1, push handle 26 is shown in a downwardly pivoted, generally vertical orientation adjacent head end 12. The push handle 26 coupled to tubes 77 at the foot end 14 is shown in its outwardly pivoted position to permit a caregiver to push the bed 10. When the push handle 26 is in the outwardly pivoted, generally horizontal position as shown adjacent to foot end 14, the push handle 26 may also be used as a tray to support items near the hospital bed 10. A raised outer perimeter edge 27 of the handle 26 defines a recessed central portion to help hold items on the tray.

Figure 2:
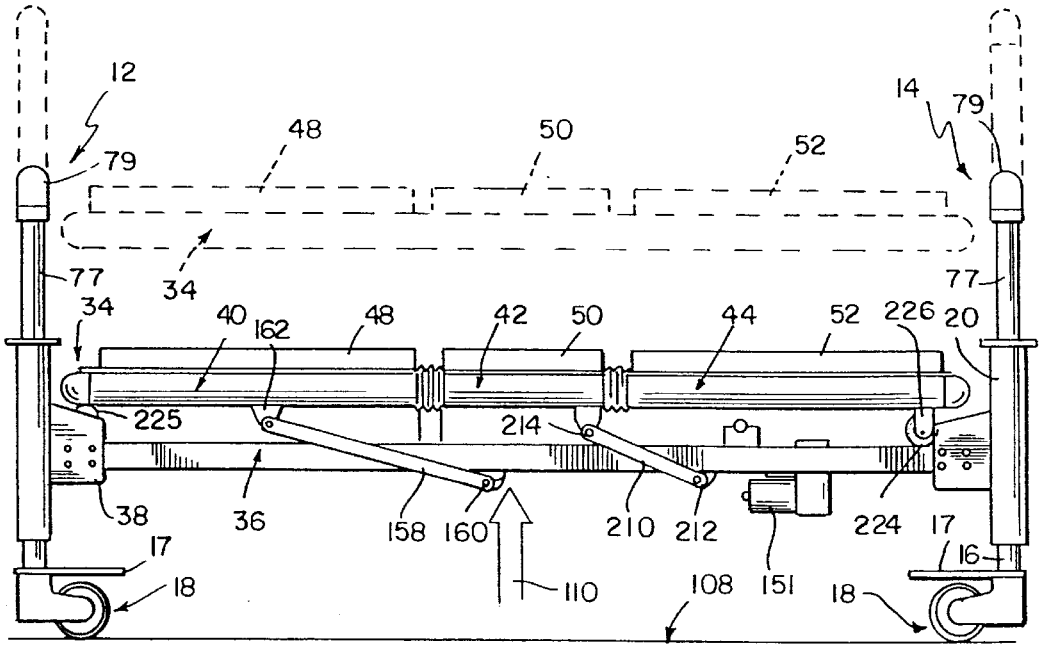
FIG. 2 is a side elevational view of the hospital bed of FIG. 1 that illustrates how the patient support surface moves between a low position close to the floor and an elevated position (shown in phantom lines)
Figure 18:
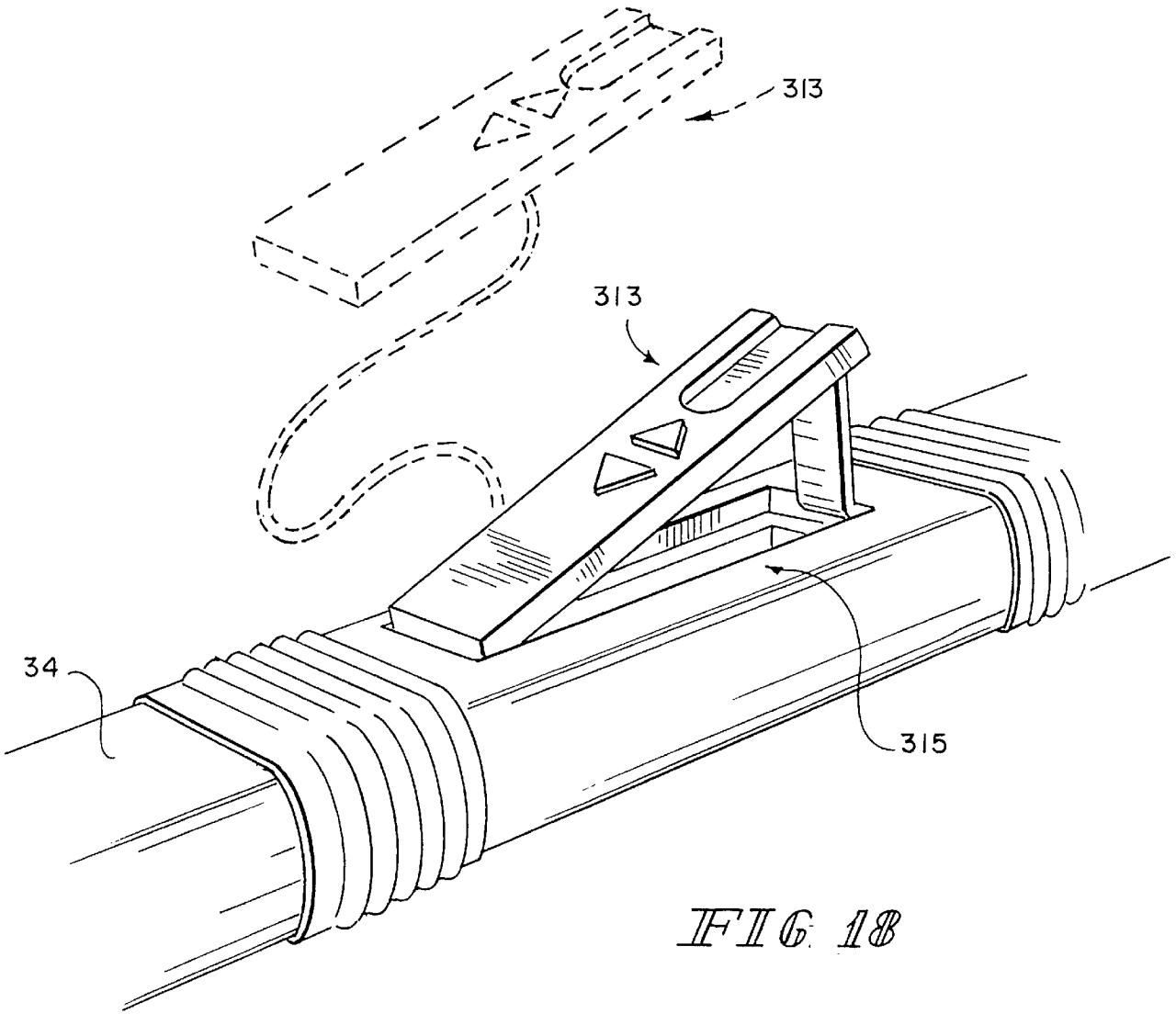
FIG. 18 is a perspective view of a pendant control according to another embodiment of the present invention which is configured to be located within a recessed portion of the perimeter frame.
Figure 19:
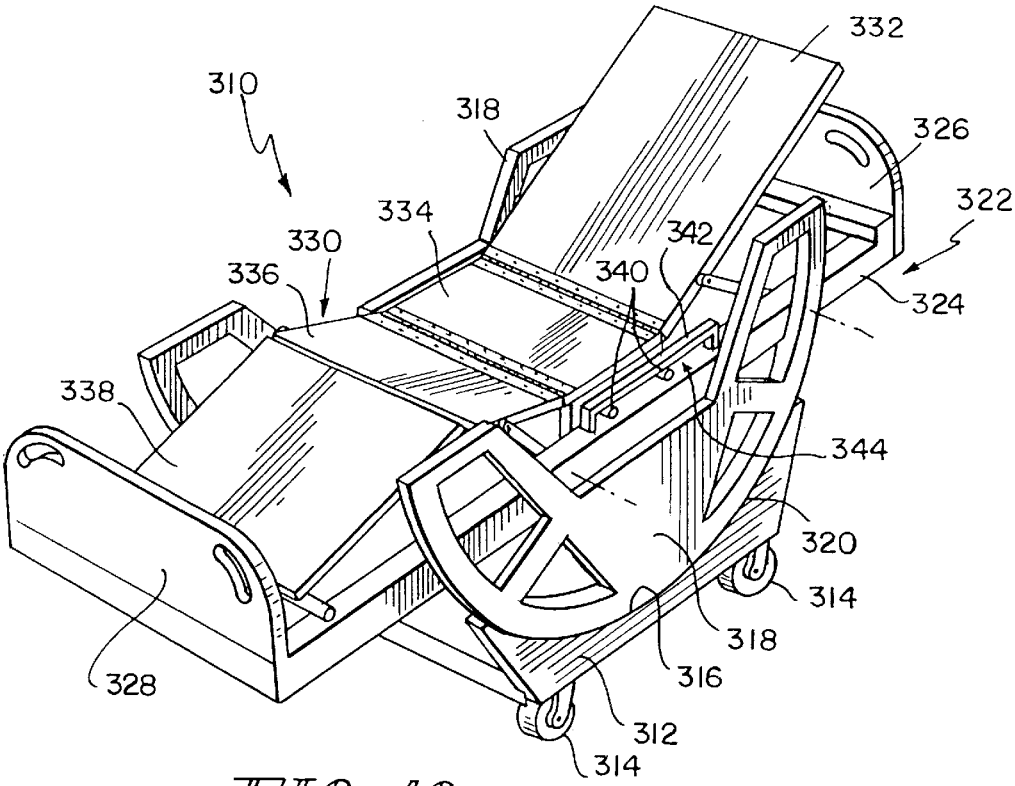
FIG. 19 is a perspective view of another embodiment of a hospital bed in accordance with the present invention.
Figure 20:
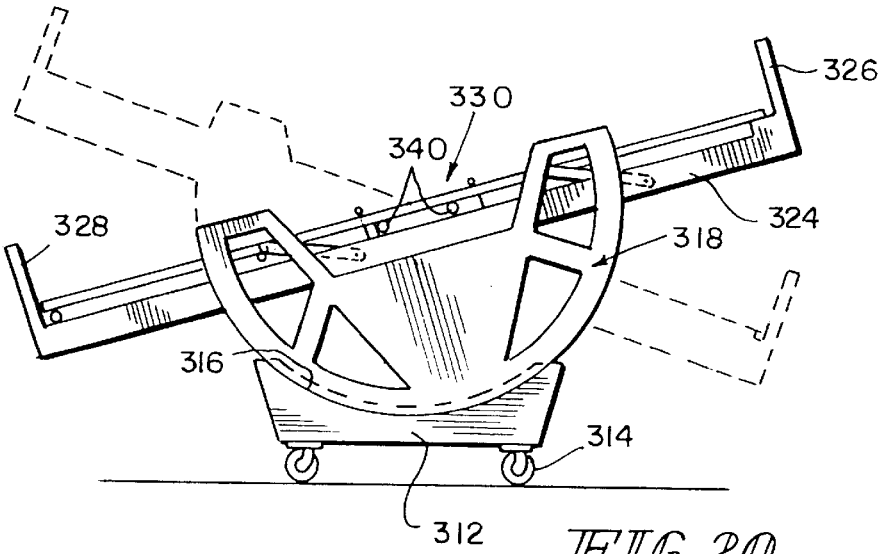
FIG. 20 is a perspective view illustrating movement of the bed about a transverse axis to move a patient support surface between a Trendelenburg and a reverse Trendelenburg position.

FIG. 2 is a side elevational view of the hospital bed of FIG. 1 that illustrates how the patient support surface is moved between a low position close to the floor and an elevated position (shown in phantom lines). A hand control pendant 30 (FIG. 1) is coupled to a controller located in a controller housing 33 (FIG. 1) for controlling hi/lo motors 32 (FIG. 1) and located at head end 12 and foot end 14 and articulation motor 151 (FIG. 2). Hand control pendant 30 is used to control the elevation of the patient support surface and articulation of a perimeter frame 34 discussed below. Another embodiment of a hand control pendant is illustrated in FIG. 18 discussed below.

An intermediate frame 36 is configured to support the perimeter frame 34. The intermediate frame 36 is coupled to the hi/lo mechanisms 24 located within covers 20 adjacent both the head and foot ends 12 and 14 by mounting brackets 38. Therefore, the intermediate frame 36 moves up and down with the covers 20, tubes 77, and push handles 26 as the hi/lo mechanisms 24 move the bed between a low position shown in solid lines in FIG. 2 and an elevated position shown in phantom lines in FIG. 2.

The perimeter frame 34 includes a head frame section 40, a seat frame section 42, and a leg frame section 44. A mattress 46 located on perimeter frame 34 also includes a separate head mattress section 48, seat mattress section 50, and leg mattress section 52 as discussed in detail below.

Figure 3:
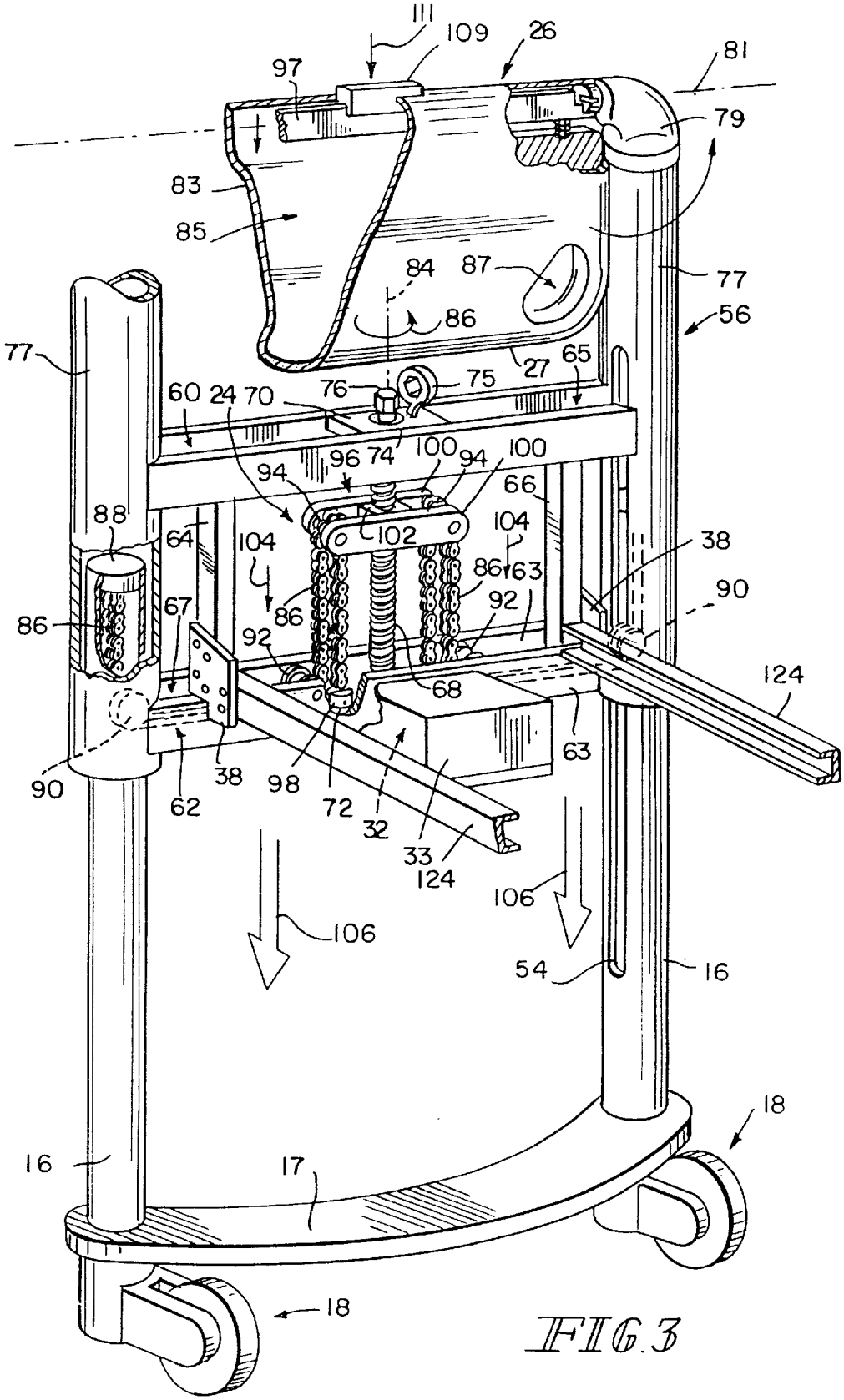
FIG. 3 is a perspective view with portions broken away illustrating a headboard having a hi/lo mechanism mounted therein for moving the intermediate support frame up and down and illustrating a pivotable push handle and tray combination coupled to the headboard.
Figure 4:
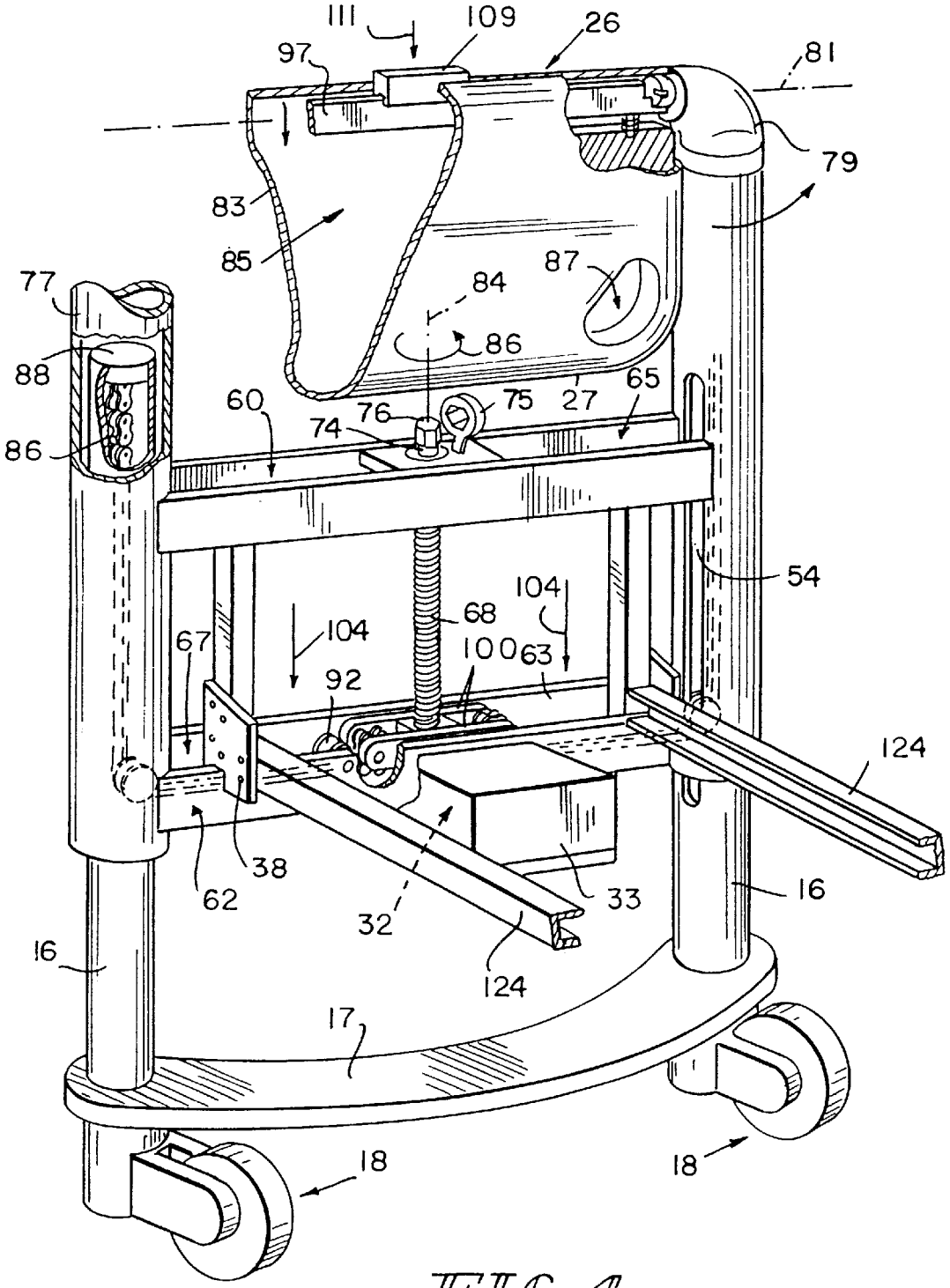
FIG. 4 is a perspective view with portions broken away illustrating the hi/lo mechanism and the intermediate support frame in lowered positions.

FIG. 3 is a perspective view with portions broken away illustrating a headboard having a hi/lo mechanism mounted therein for moving the intermediate support frame up and down and illustrating a pivotable push handle and tray combination coupled to the headboard. FIG. 4 is a perspective view with portions broken away illustrating the hi/lo mechanism and the intermediate support frame in lowered positions. As illustrated in FIG. 3, the tubes 16 are each formed to include an elongated slot 54. Hi/lo mechanisms 24 are located at both the head end 12 and foot end 14 of the bed 10. Motors 32 adjacent the head end 12 and foot end 14 are separately controllable so that the hi/lo mechanisms 24 at head end 12 and foot end 14 operate independently. The hi/lo mechanisms 24 can be operated simultaneously in the same direction to raise or lower the intermediate frame 36. In addition, the hi/to mechanisms 24 at opposite ends of the bed 10 may be operated in opposite directions to move the intermediate frame 16 to either a Trendelenburg or a reverse Trendelenburg position, if desired. Of course, if one of the hi/lo mechanisms 24 is at either its maximum high position or its minimum low position, the other hi/lo mechanism 24 is operated by itself to move the intermediate frame 36 to the Trendelenburg position or the reverse Trendelenburg position.

The hi/lo mechanisms 24 each have a carriage 56 that includes first and second outer tubes 77 that are slide over the support tubes 16. A top cross bar 60 and a bottom cross bar 62 extend between the tubes 77. Top cross bar 60 and bottom cross bar 62 include U-shaped cross sections or other shapes that define a channel therein. Vertical support bars 64 and 66 extend between the cross bars 60 and 62. Mounting brackets 38 for intermediate frame 36 are coupled to the vertical support bars 64 and 66. Covers 20 are located over the lower portion of the carriage 56 to conceal and shield the hi/lo mechanisms 24 (FIG. 1).

A threaded shaft 68 is rotatably coupled to the carriage 56. Specifically, the shaft 68 is coupled to a top support plate 70 and a bottom support plate 72 by suitable bearings 74. Top support plate 70 is coupled to top cross bar 60 in the channel 65 therein, and bottom support plate 72 is coupled to the bottom cross bar 62 in the channel 67 therein. Threaded shaft 68 is coupled to motor 32 that rotates the threaded shaft 68 in either direction about its longitudinal axis 84.

Figure 5:
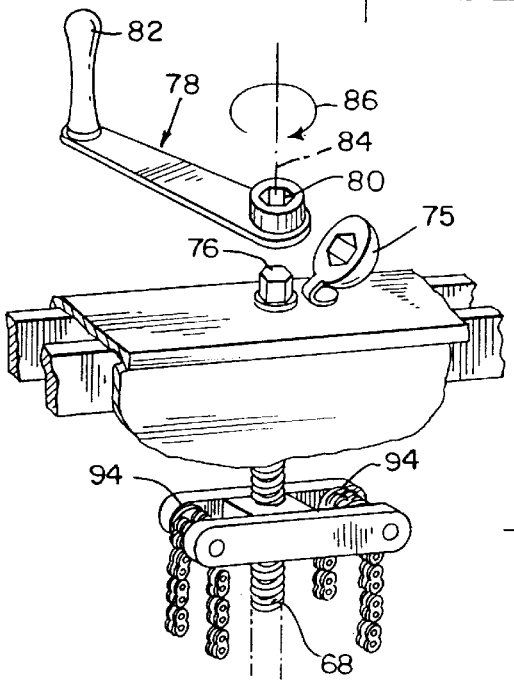
FIG. 5 illustrates an optional manual drive handle for controlling the hi/lo mechanism according to one embodiment of the present invention.

FIG. 5 illustrates an optional manual drive handle for controlling the hi/lo mechanism according to one embodiment of the present invention. A hex nut 76 is formed on top of the threaded shaft 68 to provide a manual overdrive using a manually operated crank 78 shown in FIG. 5. A removable cover 75 can be provided to cover nut 76 if desired. The crank 78 includes a hex opening 80 and a handle 82 to permit rotation of the threaded shaft about axis 84 in either direction as illustrated by double headed arrow 86 in FIG. 5. It is to be understood that shapes other than hexagonal could be used for nut 76 and opening 80 so long as such shapes allow for the crank 78 to engage and rotate threaded shaft 68.

Referring back to FIG. 3, a chain 86 is securely coupled to an upper portion or top end 88 of each support tubes 16. A chain 86 extends downwardly through each tube 16 and around rollers 90. Each chain 86 then extends inwardly within channel 67 to rollers 92 and upwardly over upper pulleys or rollers 94 that are rotatably coupled to a movable support 96. Each chain 86 then extends downwardly and is securely coupled to the lower support 72 by fastener 98. Movable support 96 includes a pair of spaced-apart plates 100 and an internally threaded member 102 located over threaded shaft 68. Rollers 90, 92, and 94 are illustratively made from a plastic material that provides quieter operation of the hi/lo mechanism. Rollers 90, 92 are rotatably coupled between opposing side support plates 63 of bottom cross bar 62.

It is to be understood that a cable, belt or similar flexible link element may be used in place of chain 86, if desired. In addition, sprockets that engage chain 86 may be used in place of the rollers 90, 92, and 94, if desired.

As the threaded shaft 68 is rotated by the motor 32 or by the manual crank 78, the movable support 96 moves up or down on the threaded shaft 68. Limit switches (not shown) are mounted to cross bars 60 and 62. The movable support 96 is configured to engage the limit switches (not shown) that in turn control operation of motors 32 to limit movement of the support 96.

The chains 86 that loop over rollers 94 on the support 96 provide twice the amount of movement of the carriage 56 relative to the tubes 16 as the amount of movement of the support 96 relative to the shaft 68. The carriage 56 is shown in its high position in FIG. 3. When the shaft 68 is rotated by motor 32 or crank 78 to move the movable support 96 downwardly in the direction of arrow 104, the carriage 56 moves downwardly twice the distance in the direction of arrow 106. This hi/lo mechanism 24 permits the patient support surface hospital bed to move between a low position shown in solid lines in FIG. 2 so that a top of perimeter frame 34 is about 33 cm. above the floor 108. When the threaded shafts 68 are rotated so as to move the movable support 96 upwardly on the shafts 68, the carriages 56 at the head end 12 and the foot end 14 move upwardly in the direction of arrow 110 in FIG. 2 to the dotted elevated position. The range of movement of the intermediate frame 36 is illustratively about 50 cm.

In the illustrated embodiment, the placement of rollers 92 on bottom cross bar 62 is selected so that the plates 100 and rollers 94 are configured to nest between the rollers 92 within channel 67 of bottom cross bar 62 when the movable support 96 moves to its low position. In other words, the plates 100 and the rollers 94 enter channel 67 of bottom cross bar 62 as depicted best in FIG. 4

Figure 6:
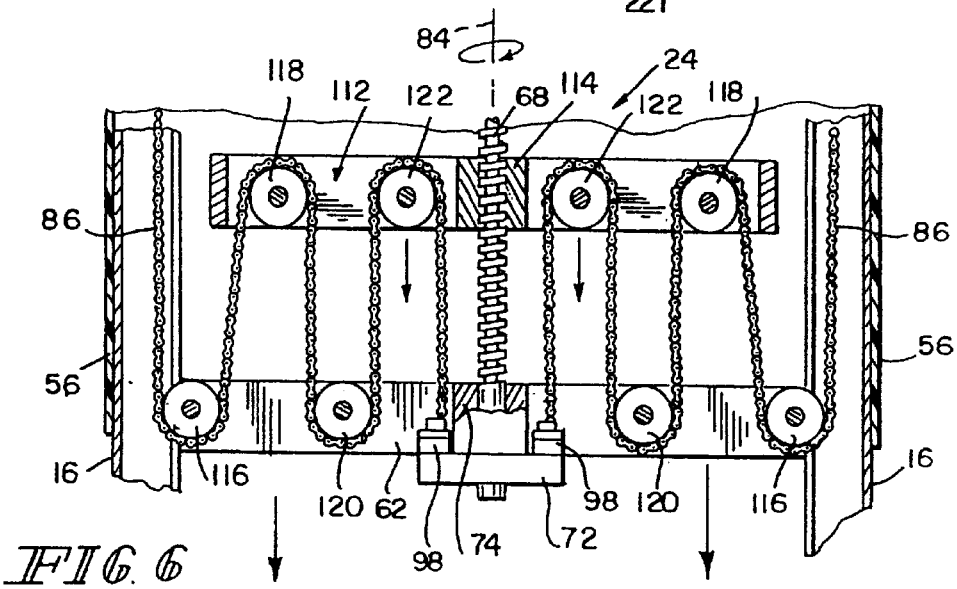
FIG. 6 illustrates an alternative embodiment of the hi/lo mechanism according to the present invention.

FIG. 6 illustrates an alternative embodiment of the hi/lo mechanism according to the present invention. Those numbers referenced by numbers similar to FIGS. 3–5 perform the same or similar function. In the embodiment of the invention depicted in FIG. 6 movable support 112 is coupled to the threaded shaft 68 by bearing 114. Each chain 86 extends downwardly over an outer roller 116 coupled to bottom cross members 62. The chain 86 then extends upwardly over outer rollers 118 coupled to movable support 112. The chains 86 then extend downwardly over inner rollers 120 coupled to cross bars 62, upwardly over inner rollers 122 coupled to movable support 112, and downwardly to fasteners 98. The chain configuration illustrated in FIG. 6 provides movement of the carriage 56 relative to the tubes 16 that is four times greater than the amount of movement of the movable support 112 relative to the threaded shaft 68.

As discussed above in reference to FIG. 3, push handles 26 are pivotably coupled to tubes 77 that extend upwardly from carriage 56. Corner connectors 79 are coupled to tubes 77 and the push handles 26 are pivotably coupled to the corner connector 79 so as to rotate about axis 81. Push handles 26 include a generally rectangular body portion 83 configured to define an interior region 85. Grip apertures 87 are formed at opposite corners of the rectangular body portion 83.

Figure 7:
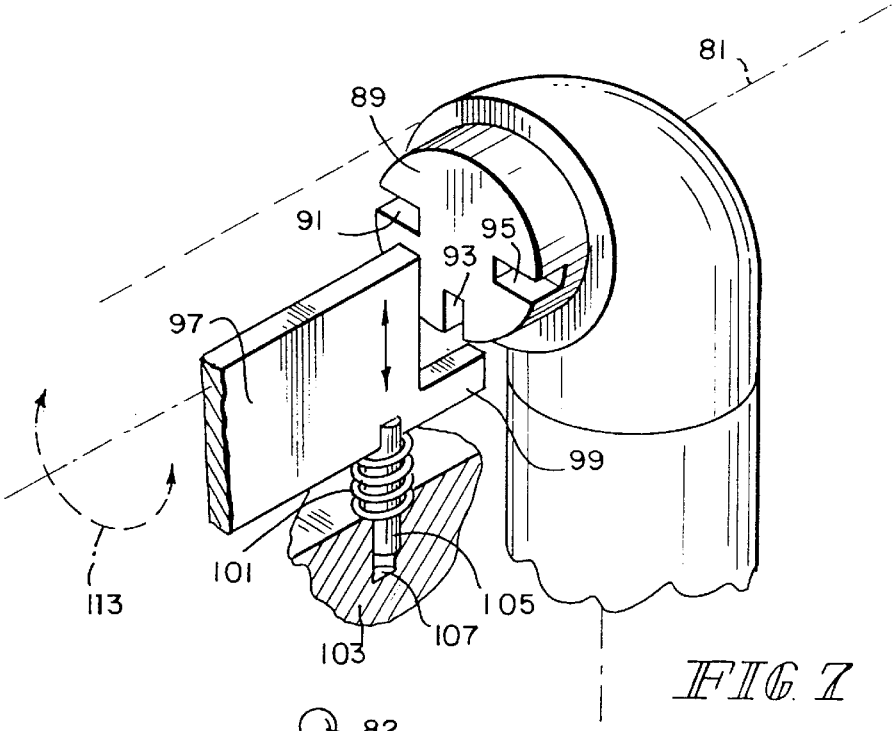
FIG. 7 illustrates a locking mechanism that is used for positioning the push handle and tray in a pre-selected position relative to the headboard or footboard.

FIG. 7 illustrates a locking mechanism that is used for positioning the push handle and tray in a pre-selected position relative to the headboard or footboard. As shown in FIG. 7, corner connectors 79 include a locking member 89 formed to include spaced apart notches 91, 93, and 95. A locking arm 97 coupled to the push handle 26 includes a tab 99 that is normally biased into one of the notches 91, 93, or 95 by a spring 101 adjacent each end of the locking arm 97. Locking arm 97 is coupled to a support 103 by a pin 105 that extends into an opening 107 formed in the support 103.

An actuator portion 109 extends through the rectangular body portion 83 so that a caregiver has access to the actuator 109 as best illustrated in FIGS. 1 and 3. When the actuator 109 is pressed in the direction of arrow 111 toward the handle 26, the locking arm 97 also moves in the direction of arrow 111 to release the locking tab 99 from one of the slots 91, 93, or 95. When the locking tab 99 is released, the push handle 26 can be rotated about the axis 81 as illustrated by double headed arrow 113 in FIG. 7. Therefore, the push handle 26 can be rotated to the generally horizontal position shown adjacent foot end 14 of the bed 10 in FIG. 1. A caregiver can then grip the push handle 26 adjacent apertures 87 to push the bed 10. Push handles 26 also provide a tray for supporting articles adjacent the bed when the push handles are in the horizontal position. When the actuator 109 is released, the springs 101 automatically force the locking tab 99 into the next slot 91, 93, or 95 to lock the push handles 26 in position. Push handles 26 adjacent head end 12 is easily removable to provide access to the head of a patient. Illustratively, removable fasteners or a latch assemblies (not shown) can be provided so that corner connectors 79 are quickly removable from tubes 77 adjacent head end 12.

Figure 8A:
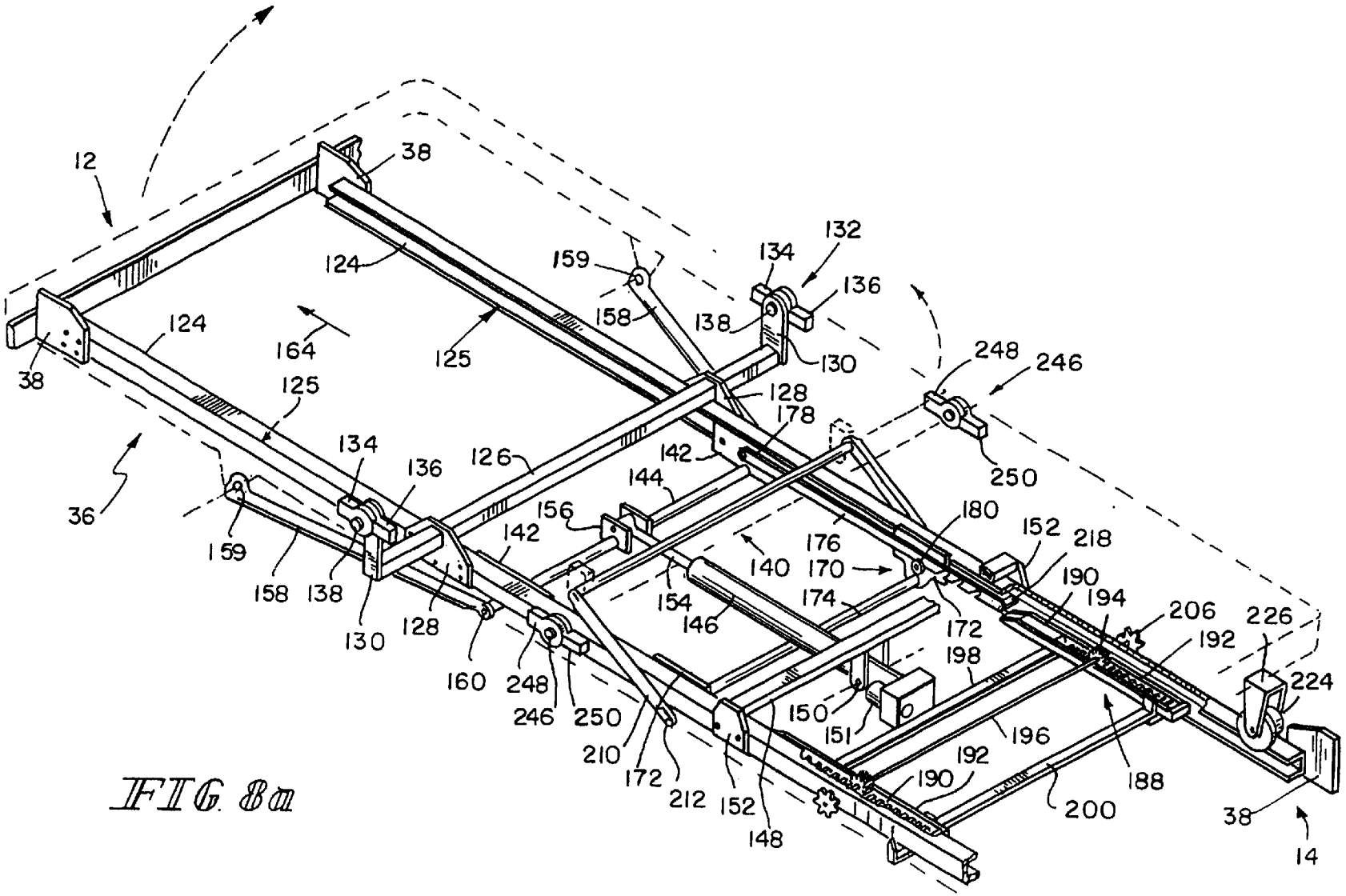
FIG. 8*a* is a perspective view illustrating details of the intermediate frame that is coupled between the headboard and a footboard of the hospital bed.

FIG. 8 is a perspective view illustrating details of the intermediate frame that is coupled between the headboard and a footboard of the hospital bed. As illustrated in FIG. 8, intermediate frame 36 includes a pair of rails 124 that extend longitudinally between the hi/lo mechanisms 24 at the head end 12 and foot end 14 of the bed 10. The rails 124 include channels 125. According to one embodiment, rails 124 have a U-shaped cross sections which define channels 125. Ends of rails 124 are coupled to brackets 38. A fixed support bar 126 extends transversely between rails 124 and is coupled to rails 124 by brackets 128. End plates 130 are coupled to opposite ends of support bar 126. Each end plate 130 is pivotably coupled to a hinge 132 including first and second hinge members 134 and 136 by a pivot connection 138. Hinges 132 are coupled to perimeter frame 34 as discussed below with reference to FIG. 12.

A head carriage 140 is movably coupled to intermediate frame 36. Head carriage 140 includes plates 142 having rollers 143 (FIG. 9) located within the rails 124. A cross bar 144 extends between plates 142. A cylinder 146 is pivotably coupled to a cross bar 148 by a connector 150. Cross bar 148 is rigidly coupled to rails 124 by brackets 152. Cylinder 146 includes a movable piston 154 that is pivotably coupled to cross bar 144 by a pivot connection 156.

Head lift arms 158 are also pivotably coupled to each end of cross bar 144 by pivot connections 160. Opposite ends 159 of head lift arms 158 are coupled to the head section 40 of perimeter frame 34 by pivot connections 162 as best shown in FIG. 2. The head section pivot hinge 132 is fixed relative to the intermediate frame 36 by support bar 126, brackets 128, and end plates 130. When the piston 154 is from cylinder 146 in the direction of arrow 164 by actuation of motor 151, head carriage 140 moves in the direction of arrow 164, thereby causing the lift arms 158 to move the head section 40 of perimeter frame 34, along with head section 48 of mattress 46, upwardly to the inclined position shown in FIG. 1.

It is understood that other types of drive mechanisms, may be used to provide movement of plates 142 and cross bar 144 if desired. It is well known in the hospital bed art that electric drive motors with various types of transmission elements including lead screw drives and various types of mechanical linkages may be used to cause relative movement of portions of hospital beds and stretchers. As a result, the term "drive mechanism" is intended to cover all types of mechanical, electromechanical, hydraulic, and pneumatic mechanisms for raising and lowering portions of bed 10, including manual cranking mechanisms of all types, and including combinations thereof such as hydraulic cylinders in combination with electromechanical pumps for pressurizing fluid received by the hydraulic cylinders.

A knee carriage 170 is provided and includes plates 172 having rollers (not shown) located within the rails 124 for movement relative to the longitudinal axis of the bed 10. A cross bar 174 extends between plates 172. A link arm 176 is pivotably coupled to each of the plates 172 of head carriage 140 by a pivot connection 178. Each arm 176 extends over a pin 180 coupled to plate 172 of knee carriage 170. The arm 176 includes a plurality of angled notched portions 182, 184, 186 (also shown in FIG. 10) that are configured to slide over and engage the pin 180 and couple the knee carriage 170 to the head carriage 140.

The intermediate frame 36 includes a knee elevation adjustment mechanism 188 having a rack 190 located in each rail 124. Racks 190 include a plurality of teeth 192 that are configured to be engaged by a gear or pinion 194. The pinions 194 are connected by a cross bar 196. Pinions 194 are rigidly coupled to the cross bar 196. In an alternative embodiment, if the pinions 194 are not used, the racks 190 can be coupled together by cross bars 198 and 200. Teeth on racks 190 are not required in this alternative embodiment. An angle indicator 202 is coupled to each rack 190 and configured to point to various angle settings the knee articulation that are marked on the outside of channels 124 as indicated by markings 204.

Figure 8B:
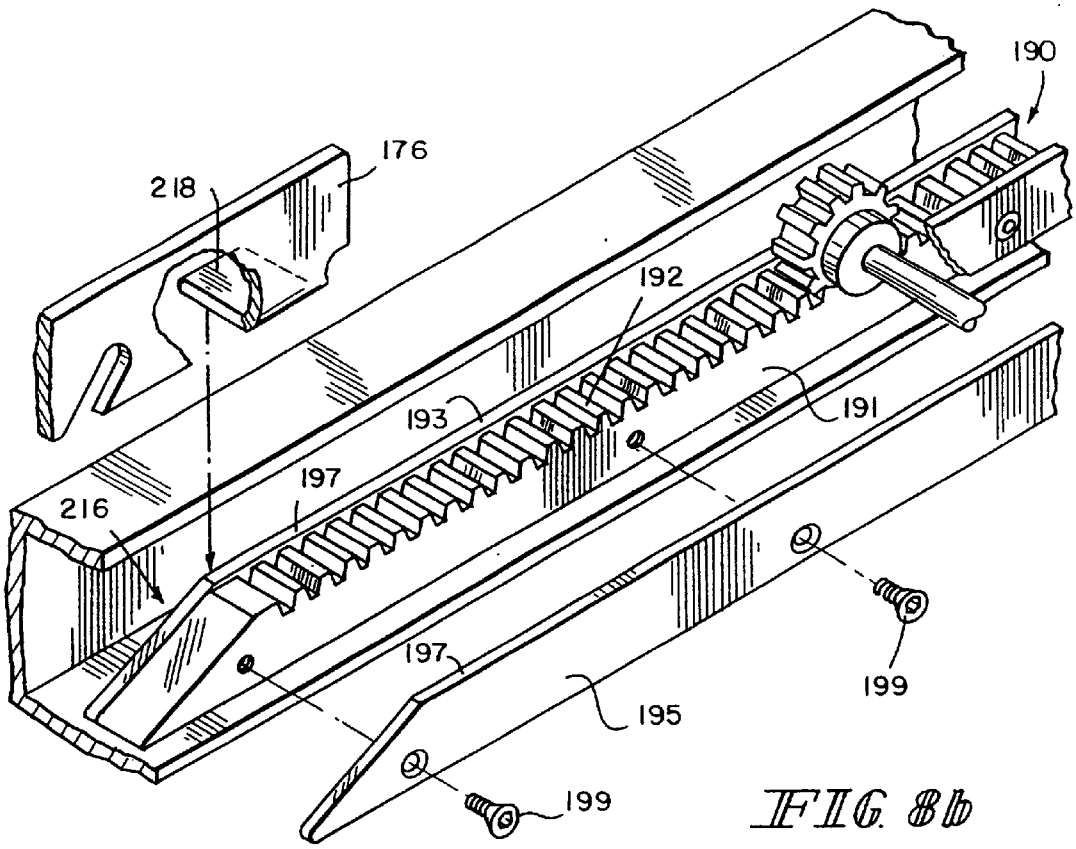
FIG. 8*b* is an enlarged, partially exploded perspective view of a rack assembly according to one embodiment of the present invention.

FIG. 8*b* is an enlarged, partially exploded perspective view of a rack assembly according to one embodiment of the present invention. The rack 190 in FIG. 8*b* includes a central portion 191 having teeth 192 formed in an upper surface. The central portion 191 is secured between side plates 193 and 195. As shown, the side plates 193 and 195 have a height that is taller than the top edges of the teeth 192 so that the teeth 192 are recessed between the side plates 193 and 195. The central portion 191 can be made of any suitable strong material such as metals, plastics, etc. The side plates 193 and 195 are made from metal or other suitable material that will resist wear from tabs 218 which slide along the ramp 216 of rack 190 and upper surfaces 197 of the side plates 193 and 195 as discussed below. As depicted, the side plates 193 and 195 are coupled together or are coupled to central portion 191 by threaded fasteners 199. In an alternative embodiment, the central portion 191 is an insert which is received in a U-shaped channel that includes, in addition to side plates 193 and 195, a bottom (not shown).

The location of the racks 190 is adjustable to control which of the notches 182, 184, 186, if any, engage the pins 180 on the knee carriage 170. In one embodiment, an operator can rotate wheels 206 that are coupled to shaft 196 on either side of intermediate frame 36 to move the racks 190 to a different location along rails 124. In other words, rotation of wheels 206 moves the racks 190 relative to the stationary pinions 194. In another alternative embodiment, the pinions 194 are replaced by any suitable mechanical connection for moving the racks 190 relative to the intermediate frame 136 to adjust the point at which the notches 182, 184 and 186 in the arms 176 engage pins 180 to control knee articulation. The adjustment knobs 206 outside the intermediate frames 36 are optional.

In another embodiment, the pinions 194 cooperate to move the racks 190 on opposite sides of intermediate frame 36 without the adjustment knob 206. In this embodiment, an operator uses the angle indicator 202 to slide the racks 190 longitudinally. As an operator moves the angle indicator 202 on one side of the intermediate frame 36, the rack 190 coupled to the angle indicator 202 also moves which causes the pinions 194 to rotate on both sides of the intermediate frame 36. Therefore, both the racks 190 move longitudinally relative to the intermediate frame 36 in response to the operator moving only one of the angle indicators 202.

In another alternative embodiment, the pinions 194 can be replaced by a suitable mechanical connection for moving the racks 190 relative to the intermediate frame 136 to adjust the point at which the notches 182, 184 and 186 in the arms 176 engage pins 180 to control knee articulation. For instance, cross bars 198 and 200 can be used to interconnect the racks 190 in this embodiment. The operator again moves the angle indicator 202. Since the racks 190 are interconnected by the cross bars 198 and 200 in this embodiment, movement of one of the angle indicator 202 and rack 190 on one side of the frame 36 causes corresponding movement of the rack 190 and angle indicator 200 on the opposite side of the frame.

A knee lift arm 210 is coupled to each end of cross bar 174 of knee carriage 170 on opposite sides of intermediate frame 36 by pivot connections 212. Opposite ends of the knee lift arms 210 are coupled to the seat section 42 of perimeter frame 34 by pivot connections 214 as shown in FIG. 2.

Figure 9:
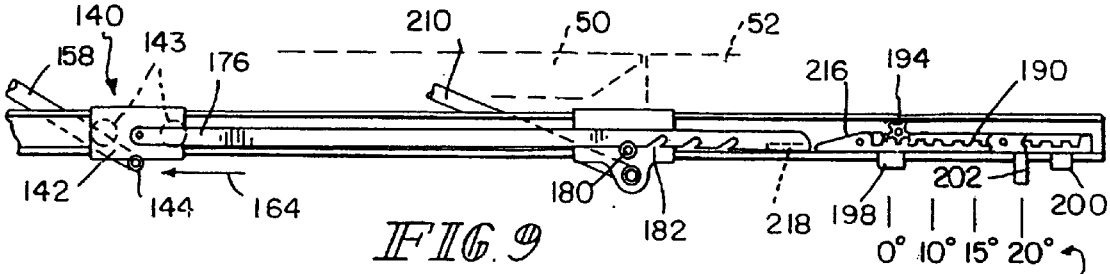
FIGS. 9–11 illustrate an adjustable knee carriage control mechanism coupled to the intermediate frame for controlling articulation between a seat section and a foot section of a perimeter frame that provides a support deck.
Figure 10:
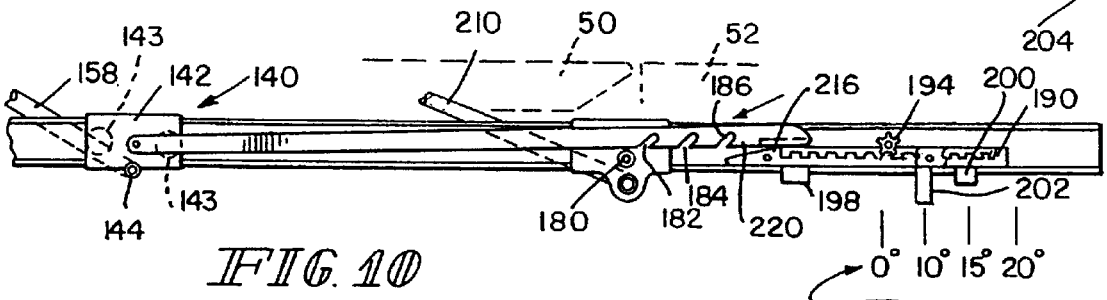
Figure 11:
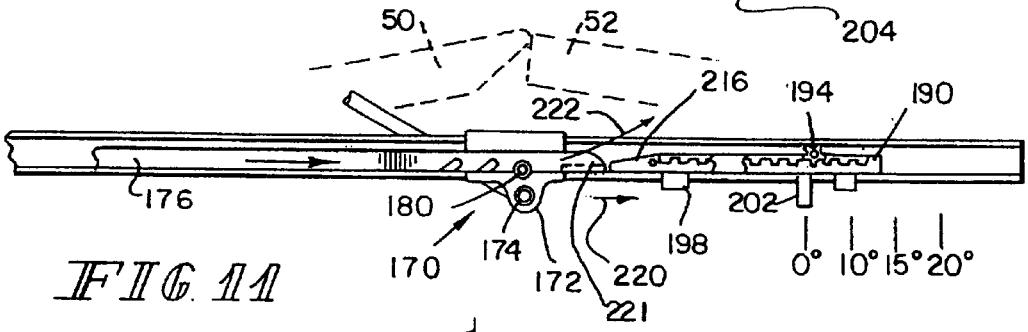

FIGS. 9–11 illustrate an adjustable knee carriage control mechanism coupled to the intermediate frame for controlling articulation between a seat section and a foot section of a perimeter frame that provides a support deck. As depicted in FIGS. 9–11, when the motor 151 is actuated to extend the piston 154 from cylinder 146, plates 142 and rollers 143 move within rails 124 in the direction of arrow 164 shown in FIG. 9. The position of racks 190 determine which of the notches 182, 184, or 186, if any, engage the pins 180. Racks 190 include a leading ramp 216 and lift arms 176 include a tab 218. Lift tab 218 is positioned to contact and slide along the ramp 216 and upper surface of one or both side plates 193 and 195 of the rack 190, so as to pass over the teeth 192 in the central portion 191 of the rack 190.

When the racks 190 are positioned as shown in FIG. 9, the indicators 202 are at the 20° knee articulation position. In this instance, as the head carriage 140 moves in the direction of arrow 164, the arms 176 move over ramp 216 so that the first angled notch 182 catches the pins 180 and pulls the knee carriage 170 in the direction of arrow 164. Therefore, the lift arms 210 begin lifting the seat and leg sections 42 and 44 of the perimeter frame 34 upwardly to provide a 20° knee articulation angle.

When the racks 190 are moved so that indicator 202 is aligned with the 15° mark, the arms 176 move down the ramps 216 later so that second notch 184 engages the pins 180. This causes delayed movement of the knee plates 172 and lift arms 210. Therefore, when the piston 154 is fully extended, the knee articulation angle is only about 15°.

FIG. 10 shows the indicator 202 at the 10° position with the racks 190 moved upwardly in the direction of arrow 164. In this rack position, the arms 176 do not move downwardly over the ramp 216 until the third notch 186 is aligned with the pins 180. Therefore, the knee only articulates 10° upon full extension of the piston 154.

Finally, when the indicator 202 is located at the 0° position, the end portions 221 of arms 176 remain on the racks 190 until all the notches 182, 184, 186 have passed the pins 180. Therefore, the lift arms 210 are not moved to lift the seat section 42 and foot section 44 upwardly.

FIG. 11 illustrates an automatic reset feature of the knee elevation adjustment mechanism 188. Illustratively, in FIG. 11, the 10° knee articulation setting was initially made so that the notches 186 on arms 176 engage the pins 180 to articulate the knee about 10°. Before the piston 154 was retracted, however, the rack was moved to the 0° position. As the piston 154 is retracted, the head carriage 140 moves in the direction of arrow 220 of FIG. 10 and pushes the arms 176 and the knee carriage 170 in the direction of arrow 220. As the arms 176 move in the direction of arrow 220, the arms 176 push the racks 190 in the direction of arrow 220. Once the seat frame section 42 and the leg frame section 44 are in the horizontal position, the knee carriage 170 stops moving in the direction of arrow 220. At that point, the arms 176 have pushed the racks 190 to the proper location for the 10° knee articulation (or the other knee articulation setting that was initially set). Further retraction of piston 154 causes the arms 176 to move upwardly in the direction of arrow 222 over ramps 216 of racks 190 due to the angle of notches 182, 184, and 186.

As shown in FIGS. 2 and 8, a roller 224 is rotatably coupled to leg section 44 of frame 34 by bracket 226. Rollers 224 ride on top of rails 124 as the foot section 44 of frame 34 moves toward head end 12 during knee articulation. Stops 225 shown in FIG. 2 provide support for the head frame section 40 in its horizontal position.

Figure 12:
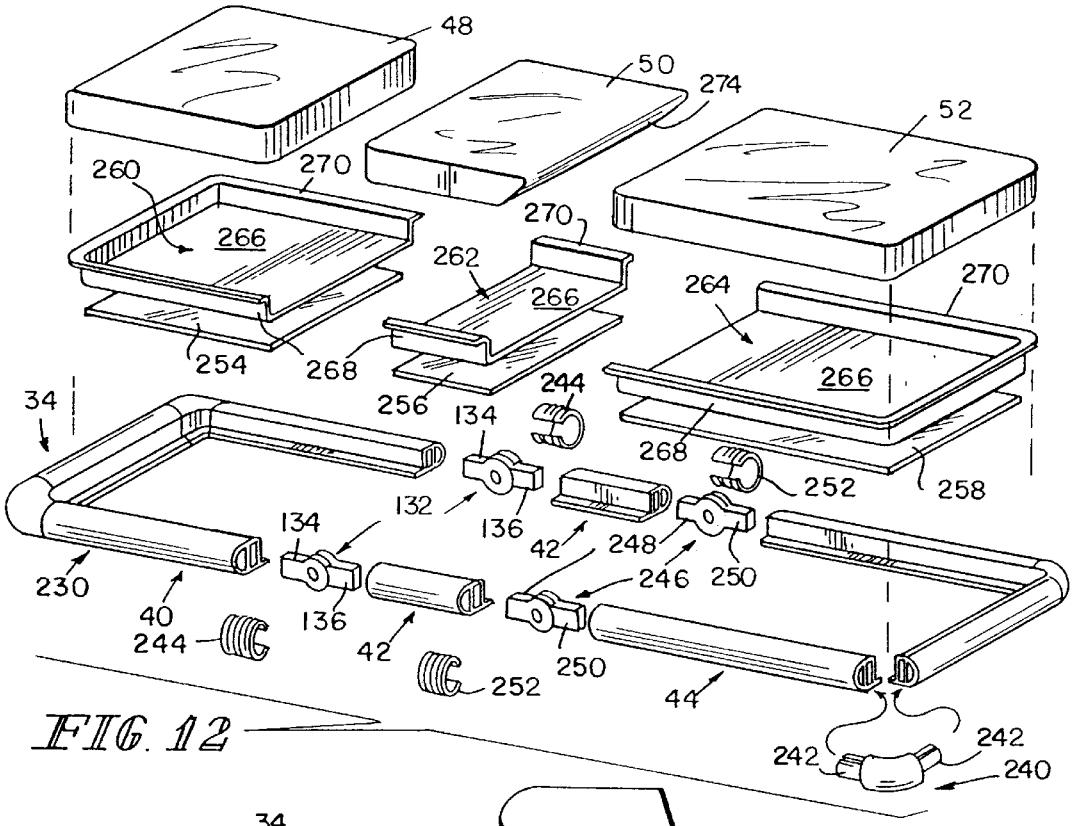
FIG. 12 is an exploded perspective view illustrating details of the perimeter frame for supporting radiolucent panels, sleep surface inserts and mattress sections to support a patient.
Figure 13:
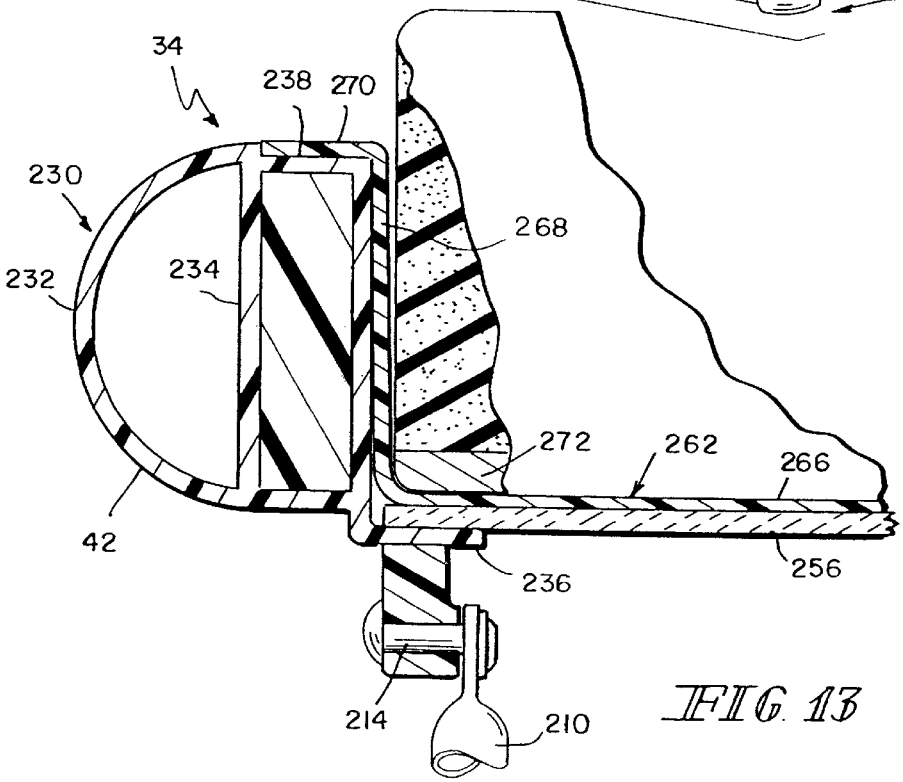
FIG. 13 is a sectional view taken along plane XIII—XIII of FIG. 1 illustrating additional details of the perimeter frame, the radiolucent panel, the sleep surface insert, and the mattress of FIG. 10.

FIG. 12 is an exploded perspective view illustrating details of the perimeter frame for supporting radiolucent panels, sleep surface inserts and mattress sections to support a patient. FIG. 13 is a sectional view taken along plane XIII—XIII of FIG. 1 illustrating additional details of the perimeter frame, the radiolucent panel, the sleep surface insert, and the mattress of FIG. 10. As illustrated, the perimeter frame 34 is formed from lengths of an extruded member 230 having a cross section best illustrated in FIG. 13. Illustratively, extruded member 230 includes an outer semi-circular shaped portion 232 and an inner rectangular shaped portion 234. It is understood that other shapes are possible in accordance with the present invention. Rectangular portion 234 includes an inwardly extending flange 236 and a notched top ledge 238. The extrusion member 230 may be formed from a suitable metal or plastic material.

The head section 40, seat section 42, and leg section 44 of perimeter frame 34 are all formed from the same extruded members 230 that are cut to different lengths. Corner portions 240 include ends 242 having the same cross sectional configuration as the semi-circular portion 232 and rectangular portion 234 of extruded frame members 230. Therefore, ends 242 of corner portions 240 slide into the openings of the extruded members 230 to secure the corner portions 240 to the frame sections 40, 42, and 44. Head frame section 40 and foot frame section 44 of perimeter frame 34 have identical shapes to facilitate manufacturing of the hospital bed 10.

Hinge members 134 and 136 extend into the rectangular portions 234 of both the head frame section 40 and seat frame section 42 in order to pivotably couple the head frame section 40 to the seat frame section 42. A flexible cover 244 surrounds each hinge 132.

Similar hinges 246 are located between seat frame section 42 and foot frame section 44. Hinges 246 include a first hinge member 248 configured to be inserted into the rectangular portion 234 of seat frame section 42. A second hinge member 250 is configured to be inserted into the rectangular portion 234 of the foot frame section 44. Flexible covers 252 are configured to surround hinges 246. Hinge members 134, 136, 248, and 250 are all identically shaped. Therefore, the configuration of hinges 132 and 146 also facilitates manufacture of the bed 10.

Radiolucent panels 254, 256, and 258 are coupled to the head section 40, seat section 42, and foot section 44, respectively, of perimeter frame 34. Support surface inserts 260, 262, and 264 are located on the head section 40, seat section 42, and foot section 44 of perimeter frame 34, respectively. Each of the support surface inserts 260, 262, and 264 includes a bottom surface 266, an upwardly extending sidewall 268, and an outwardly extending flange 270. Flanges 270 of the inserts 260, 262, and 264 are located on ledges 238 of extruded members 230 as depicted in FIG. 13. The sidewalls 268 extend downwardly along the periphery of the support surface and the bottom surfaces 266 extend over radiolucent panels 254, 256, or 258. Illustratively, the support surface inserts 260, 262, and 264 are formed from a molded plastic material. Inserts 260, 262, and 264 facilitate cleaning by providing a wipable surface that catches fluids or other contaminants. Mattress sections 48, 50, and 52 are located in inserts 260, 262, and 264, respectively. Velcro strips (not shown) can be provided between the mattress sections 48, 50, and 52 and the inserts 260, 262, and 264 to secure the mattress sections 48, 50 and 52 in place. As best shown in FIG. 12, seat mattress section 50 includes an inclined edge surface 274 located adjacent foot section 52. This inclined edge 274 facilitates movement during knee articulation.

In an alternative embodiment, the mattress sections 48, 50, and 52 may sit directly on the radiolucent panels 254, 256, and 258, respectively. In yet another embodiment, the mattress sections can be formed with a suitable rigid bottom portions 272 as depicted in FIG. 13. Such reinforced mattress sections 48, 50, and 52 may sit directly on the head section 40, seat section 42, and leg section 44, respectively, of perimeter frame 34 with the rigid support portions 272 engaging flanges 236. When the reinforced bottom 272 is used, the inserts 260, 262, and 264 may be used without the radiolucent panels 254, 256, and 258 to facilitate cleaning of the bed.

In yet another embodiment of the invention, a stronger material can be used for support surface inserts 260, 262, and 264. In this embodiment, the mattress sections 48, 50, and 52 can be located directly over the inserts 260, 262, and 264, respectively, without the radiolucent panels 254, 256, and 258.

Flexible portions (not shown) or other suitable retainers are used to hold the panels 254, 256, and 258 and the inserts 260, 262, and 264 in a proper position on the perimeter frame 34.

Figure 14:
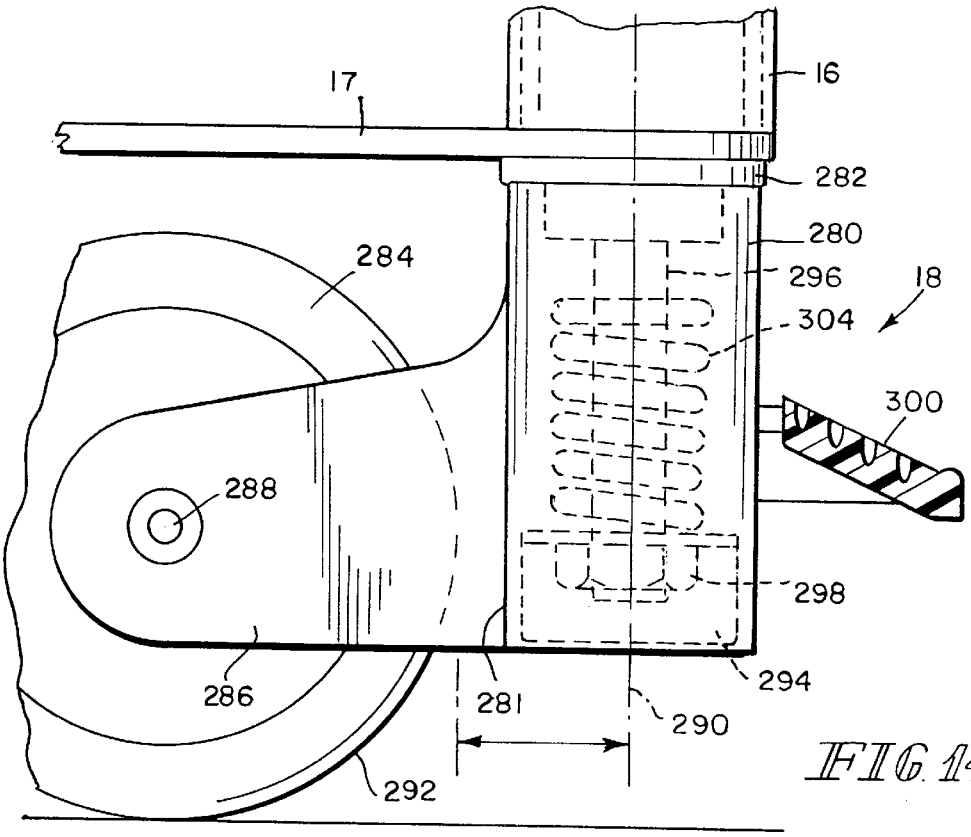
FIG. 14 is a side elevational view of a caster assembly and braking mechanism of the present invention.
Figure 15:
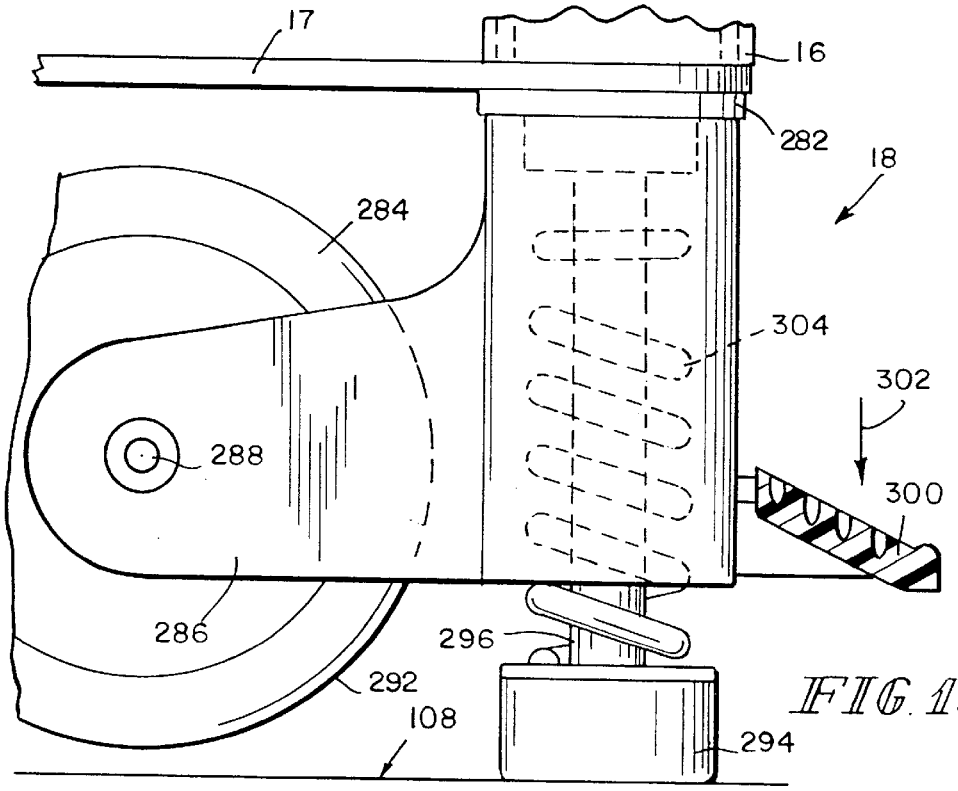
FIG. 15 illustrates a brake pad that is moved downwardly by a pedal to engage the floor and brake the caster.

FIG. 14 is a side elevational view of a caster assembly and braking mechanism of the present invention. FIG. 15 illustrates a brake pad that is moved downwardly by a pedal to engage the floor and brake the caster. Each caster assembly 18 includes an outer cylindrical portion 280 rotatably coupled to the support tubes 16. A washer 282 is located between support members 17 and cylindrical portion 280. Caster 284 is coupled to lateral support members 286 extending away from cylindrical portion 280 about an axis 288 of the rotation. Axis 288 is spaced apart from a central axis 290 of cylindrical portion 280 and tubes 16 by a sufficient distance so that an outer edge 292 of caster 284 is spaced apart from axis 290 and from an edge 281 of cylindrical portion 280. This offset caster 284 permits the cylinder 280 and tubes 16 to be located closer to the floor 108 to achieve a lower position of intermediate frame 36 relative to the floor 108.

A brake pad 294 is coupled to a shaft 296 by a fastener 298. The brake pad 294 is movable from a retracted position shown in FIG. 14 to an extended position illustrated in FIG. 15 to engage the floor 108 and brake the bed 10. A brake pedal 300 is coupled to post 296. When brake pedal 300 is moved downwardly in the direction of arrow 302, the brake pad 294 moves to its extended position depicted in FIG. 15. A spring 304 is configured to assist downward movement of the brake pad 294. When an operator moves the pedal 300 upwardly, a latch (not shown) secures the brake pad 294 in the retracted position.

Figure 16:
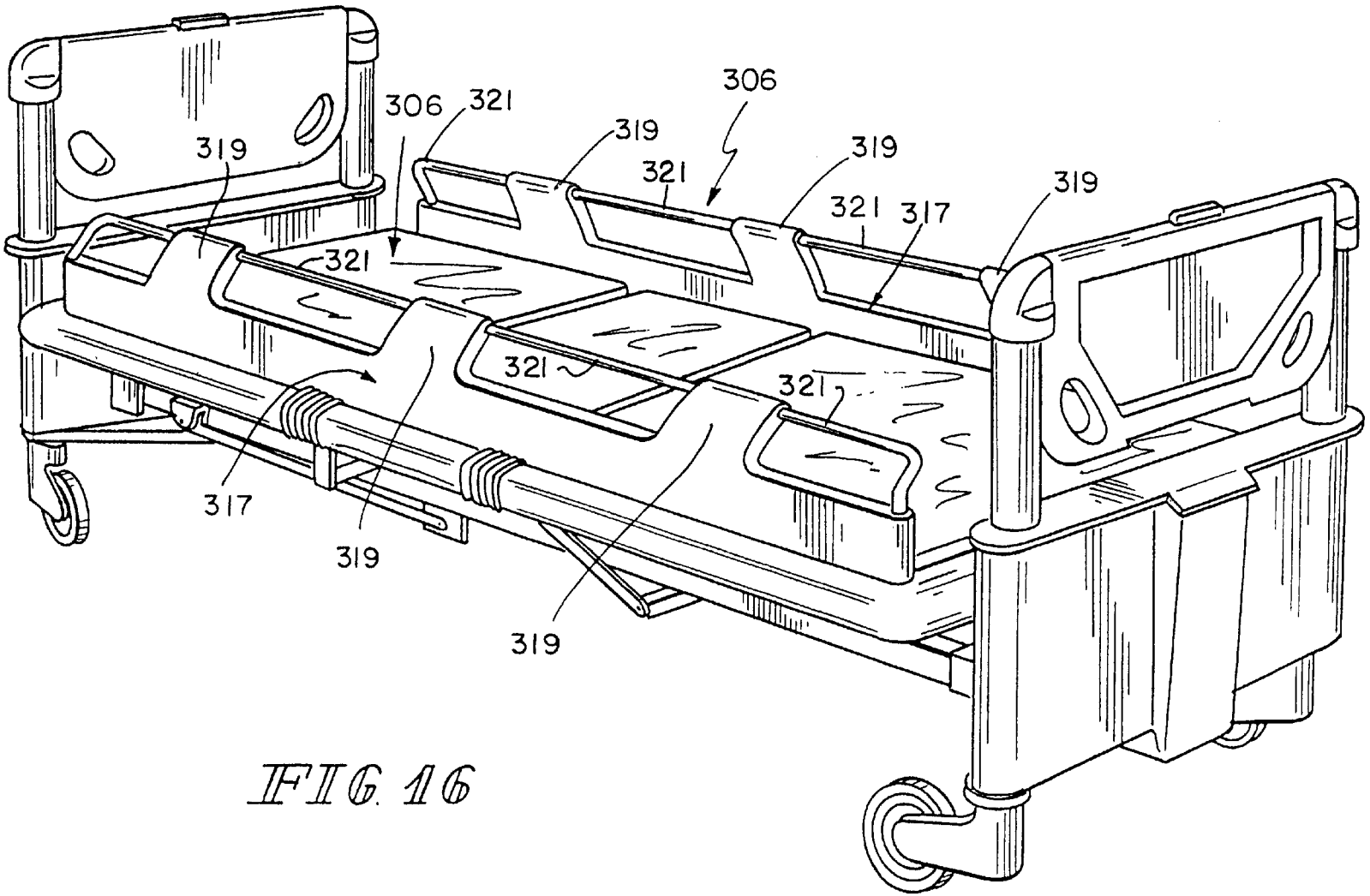
FIG. 16 is a perspective view of a hospital bed according to one embodiment of the present invention which includes a pair of optional full length siderails.

FIG. 16 is a perspective view of a hospital bed according to one embodiment of the present invention that includes a pair of optional full length siderails.

The full length siderails 306 include siderail frames 317 having support arms 319 that support tubular rails 321. The siderail frames 317 are either pivotably or non-pivotably coupled to the perimeter frame 34 or the intermediate frame 36 on opposite sides of the bed 10. The support arms 319 extend upward and can optionally curve slightly inward as shown.

Figure 17:
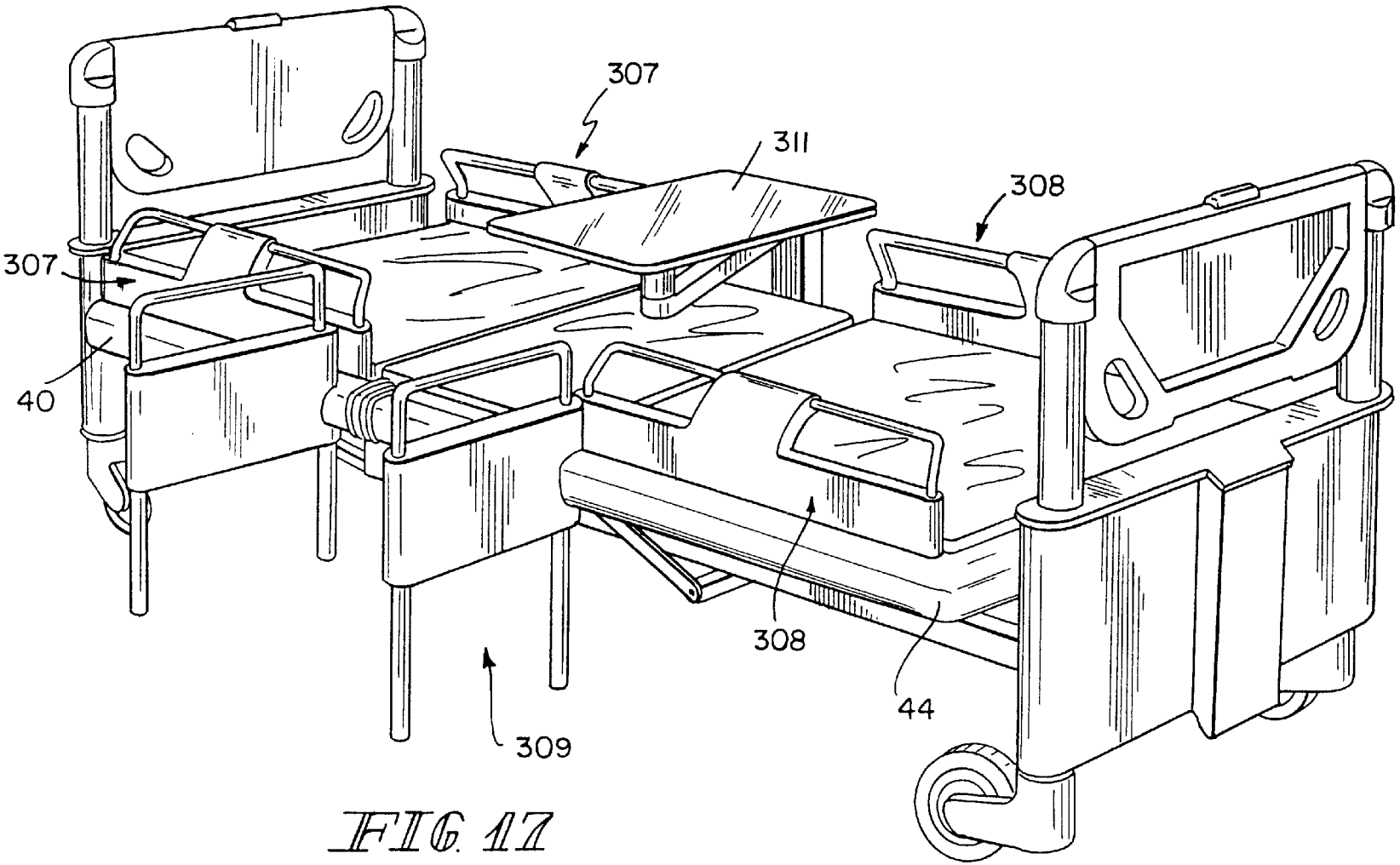
FIG. 17 is a perspective view of a hospital bed according to another embodiment of the present invention which includes optional half length siderails.

FIG. 17 is a perspective view of a hospital bed according to another embodiment of the present invention which includes optional half length siderails. The half length siderails 307 and 308 are coupled to opposite sides of the bed 10 adjacent the head section 40 and foot section 44, respectively, of the perimeter frame 34. FIG. 17 also shows a pair of patient assist devices 309 that have handles to assist a patient getting into and out of the bed 10. The patient assist devices 309 include telescoping legs to compensate for variation in height of the intermediate frame 36 off the floor 108. Illustratively, the patient assist devices 309 are coupled to one of the siderails 307, 308, the perimeter frame 34, or the intermediate frame 36. An overbed table 311 is also illustrated in FIG. 17. The overbed table 311 may include a stand located on the floor. The overbed table 311 may also be coupled to one of the perimeter frame 34 or the intermediate frame 36.

Another embodiment of a hand pendant control 313 is illustrated in FIG. 18. In the FIG. 18 embodiment, the pendant 313 is configured to be located within a recessed portion 315 formed in the perimeter frame 34. The pendant 313 may be pivotably coupled to the perimeter frame 34, or the pendant 313 may be removable from the perimeter frame for use by an operator. The pendant 313 includes a stand pivotably coupled to the pendant 313 to permit the pendant 313 to rest in an inclined position shown in FIG. 18. The stand is pivotably coupled to the pendant 313 so that the pendant 313 can nest within the recessed portion 315 of the perimeter frame 34 when the stand is folded against the pendant 313.

Another embodiment of the invention is illustrated in FIGS. 19–22. A hospital bed 310 includes a base 312 having a plurality of casters 314. The base includes a curved bearing portions 316 configured to receive side support members 318. Side support members 318 each include a curved bearing surface 320 that engages the bearing surface 316 of base 312. A support frame 322 includes a pair of spaced apart side frame members 324 that are coupled to supports 318. A headboard 326 and a footboard 328 are coupled to opposite ends of frame members 324.

An articulating deck 330 is also coupled to frame members 324. Deck 330 includes a head section 332, a seat section 334, a thigh section 336, and a foot section 338. Each of the deck sections 332, 334, 336, and 338 are pivotably coupled to an adjacent deck section by suitable hinges. Seat section 334 includes guide posts 340 that extend outwardly from both side portions of the seat section 334. A guide bar 342 is coupled to each of the frame members 324. Guide bars 342 define a slot 334 for receiving the posts 340 coupled to seat frame section 334.

A suitable drive mechanism (not shown) is coupled between the base 312 and the support frame 322 to pivot the support frame 322 and the deck 330 about a transverse pivot axis so that the deck 330 can be moved between a Trendelenburg position and a reverse Trendelenburg position.

A threaded drive shaft 346 is pivotably coupled to head frame section 332 by connector 348. A motor 350 is coupled to the drive shaft 346. Motor 350 is pivotably coupled to the support frame 322 by connector 352.

Opposite sides of thigh sections 336 of deck 330 are pivotably coupled to link arms 354 by pivot connections 356. Opposite ends of link arms 354 are pivotably coupled to side frame members 324 by pivot connection 357. Opposite sides of head section 332 of deck 330 are coupled to link arms 358 by pivot connections 360. Opposite ends of link arms 358 are pivotably coupled to side frame members 324 by pivot connections 362.

Figure 21:
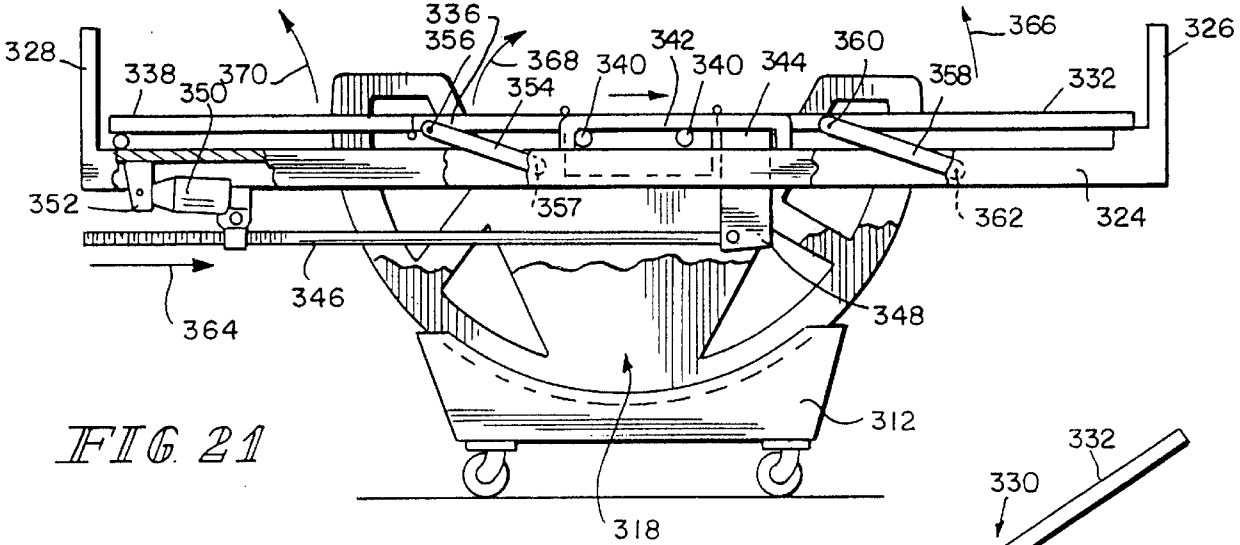
FIG. 21 is a side elevational view, with portions broken away, illustrating a drive mechanism for articulating a patient support deck with a deck in a generally planar position.
Figure 22:
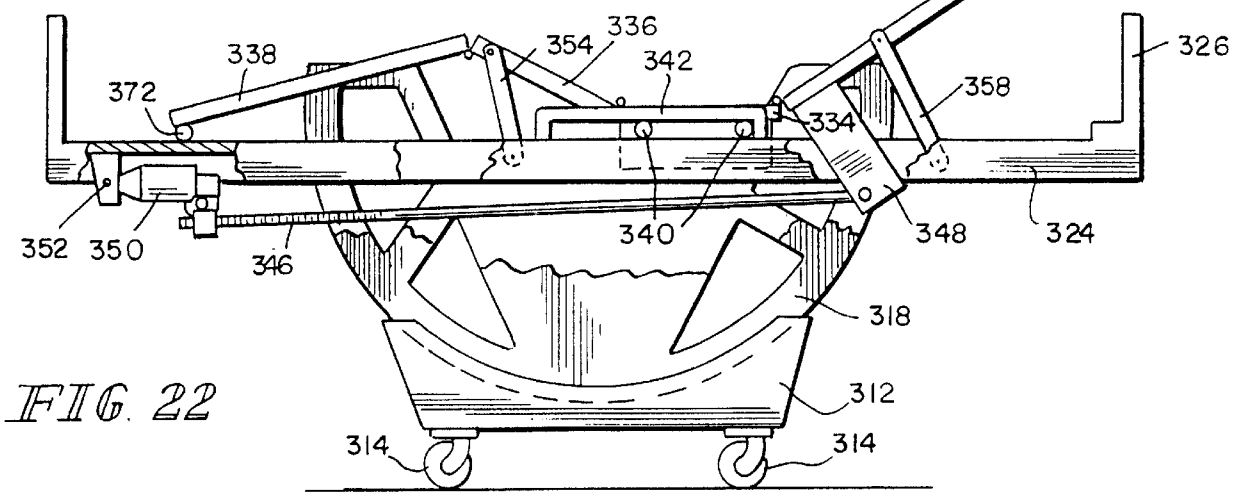
FIG. 22 is a side elevational view similar to FIG. 17 in which the drive mechanism has been actuated to articulate the patient support deck.

FIG. 21 illustrates the deck 330 in a generally planar configuration. When the motor 350 is actuated, threaded shaft 346 moves in the direction of arrow 364. This causes the deck 330 to move in the direction of arrow 364 to the position shown in FIG. 22. Since the head section 334 is linked to the frame members 324, the head section 334 pivots upwardly in the direction of arrow 366 of FIG. 21. Thigh section 336 pivots upwardly in the direction of arrow 368 and foot section 338 pivots upwardly in the direction of arrow 370 so that the deck 330 moves to its articulated position shown in FIG. 22 as the threaded shaft 346 moves in the direction of arrow 364. A support post 372 coupled to foot section 338 slides over the frame members 324 as the deck 330 moves to its articulated position. It is understood that rollers could be used in place of posts 372. In addition, the slot 344 is preferably formed by a track in a side frame member so that the track 334 is not exposed. Link arms 354 and 358 are moved inwardly toward a center of the bed 10 in another embodiment.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A patient support assembly comprising:

a bed frame that is supported at opposite ends;

a perimeter frame that includes a head section, a seat section, and a foot section, the seat section being coupled to the head section by a pair of first hinges and coupled to the foot section by a pair of second hinges;

a support bar that is coupled to the bed frame and to each of the pair of first hinges in a fixed position relative to the bed frame and to the pair of first hinges; and head, seat and foot inserts which are received within the respective head, seat and foot sections of the perimeter frame.

2. A patient support assembly according to claim 1, wherein the perimeter frame is formed from a plurality of extruded elongate members that are coupled together by the first and second pair of hinges and corner portions.

3. A patient support assembly according to claim 2, wherein the plurality of extruded elongate members have a cross sectional shape that includes a semi-circular portion and rectangular portion, with the semi-circular portion facing outward.

4. A patient support assembly according to claim 1, wherein the pair of second hinges are not directly attached to the bed frame.

5. A patient support assembly according to claim 1, wherein the head section of the perimeter frame is coupled to the bed frame by a first pair of pivotal arm members.

6. A bed assembly having a height-adjustable patient support surface which bed comprises:

a head end and a foot end;

a pair of hollow support tubes at each of the head end and the foot end;

a first carriage movably coupled to the pair of hollow support tubes at the head end and a second carriage movably coupled to the pair of hollow support tubes at the foot end;

a frame for supporting a patient support surface, said frame having opposite ends that are coupled to the first and second carriage; and a mechanism for raising and lowering the first and second carriages and the frame with respect to the pairs of hollow support tubes, the mechanism including a rotatable threaded shaft having a movable support coupled thereto for movement along the shaft, and at least two upper pulleys coupled to the movable support for movement therewith along the threaded shaft.

7. A bed assembly according to claim 6, wherein each of the first and second carriages comprise outer tubes that slide over the pairs of hollow support tubes.

8. A bed assembly according to claim 7, wherein each of the first and second carriages includes a top cross bar and a bottom cross bar that extend between the outer tubes.

9. A bed assembly according to claim 8, wherein the rotatable threaded shaft is rotatably coupled at opposite ends thereof to the top cross bar and the bottom cross bar.

10. A bed assembly according to claim 6, wherein the mechanism further includes a flexible link element that is coupled between the movable support and upper portions of the hollow support tubes.

11. A bed assembly according to claim 10, wherein the mechanism further includes a least two lower pulleys coupled to the bottom cross bar and the flexible link element is wound in a serpentine manner between the first and second pulleys.

12. A bed assembly according to claim 10, wherein the flexible link element extends into the hollow support tubes.

13. A bed assembly according to claim 10, wherein the flexible link element is a chain.

14. A bed assembly according to claim 6, wherein the mechanism comprises an electric motor.

15. A bed assembly according to 6, wherein the mechanism includes a manual crank.

16. A patient support assembly, comprising:

a bed frame that is supported at opposite ends;

a perimeter frame that includes a head section, a seat section, and a foot section, the seat section being coupled to the head section by a pair of first hinges and coupled to the foot section by a pair of second hinges;

a support bar that is coupled to the bed frame and to each of the pair of first hinges; and head, seat, and foot inserts which are received within in the respective head, seat, and foot sections of the perimeter frame;

wherein the head section of the perimeter frame is coupled to the bed frame by a first pair of pivotal arm members;

and wherein the bed frame includes a pair of parallel rails and a head carriage which is movable along the pair of parallel rails and the first pair of pivotal arm member are coupled to the head carriage for movement therewith.

17. A patient support assembly according to claim 16, wherein the bed frame further includes a knee carriage which is coupled to the seat section of the perimeter frame by a second pair of pivotal arms.

18. A patient support assembly according to claim 17, further including a pair of link arms that are coupled at one end to the head carriage and include opposite ends that have a plurality of notches formed therein for engaging the knee carriage.

19. A patient support assembly according to claim 18, further including a knee elevation adjustment mechanism which comprises a pair of racks that are movable along the pair of parallel rails, the position of the racks determines which of the plurality of notches engage the knee carriage.

20. A patient support assembly according to claim 16, further comprising an actuator for moving the head carriage along the pair of parallel rails.

21. A hospital bed which comprises:

a head end and a foot end;

a pair of hollow support tubes at each of the head end and the foot end;

a first carriage having a pair of spaced apart outer tubes and being movably coupled to the pair of hollow support tubes at the head end and a second carriage having a pair of spaced apart outer tubes and being movably coupled to the pair of hollow support tubes at the foot end;

a frame for support a patient support surface, said frame having opposite ends that are coupled to the first and second tubes;

a mechanism for raising and lowering the first and second carriages and the frame with respect to the pairs of hollow support tubes;

a perimeter frame that includes a head section, a seat section, and a foot section, the seat section being coupled to the head section by a pair of first hinges and coupled to the foot section by a pair of second hinges;

a support bar that is coupled to the frame and to each of the pair of first hinges;

head, seat and foot inserts which are received within the respective head, seat and foot sections of the perimeter frame;

corner connectors provided on tops of at least one of the pair of spaced apart outer tubes; and a push handle pivotally coupled between the corner connectors.

22. A patient support assembly, comprising:

a bed frame that is supported at opposite ends;

a perimeter frame that includes a head section, a seat section, and a foot section, the seat section being coupled to the head section by a pair of first hinges and coupled to the foot section by a pair of second hinges;

a support bar that is coupled to the bed frame and to each of the pair of first hinges; and head, seat, and foot inserts which are received within the respective head, seat, and foot sections of the perimeter frame;

wherein the perimeter frame is formed from a plurality of extruded elongate members that are coupled together by the first and second pair of hinges and corner portions;

the head, seat, and foot inserts each having upper outwardly projecting flanges and the plurality of extruded elongate members having upper ledges to receive the upper outwardly projecting flanges of the head, seat, and foot inserts.

23. A pivotal push handle assembly for hospital beds which comprises:

spaced-apart posts at an end of a bed;

corner connectors provided on tops of the spaced-apart posts; and a push handle pivotally coupled between the corner connectors;

wherein the push handle comprises a substantially rectangular shaped structure that is pivotable about one side;

wherein the push handle comprises a hollow portion and a biased locking mechanism which locks the push handle in one of the plurality of pivotal positions; and wherein the locking mechanism comprises a biased locking arm which engages one of a plurality of notches provided in each of the corner connectors.

* * * * *